United States Patent [19]

Laflin et al.

[11] 4,137,970

[45] Feb. 6, 1979

[54] PACKER WITH CHEMICALLY ACTIVATED SEALING MEMBER AND METHOD OF USE THEREOF

[75] Inventors: George P. Laflin, Denver; Clarence J. Durborow, Englewood, both of Colo.

[73] Assignee: The Dow Chemical Company, Midland, Mich.

[21] Appl. No.: 789,055

[22] Filed: Apr. 20, 1977

[51] Int. Cl.[2] ..... E21B 33/12; E21F 16/00

[52] U.S. Cl. ..... 166/292; 166/179; 166/315; 166/294

[58] Field of Search ..... 166/179, 185, 191, 196, 166/118, 187, 295, 294, 315, 292; 277/DIG. 6; 61/40, 41

[56] References Cited

U.S. PATENT DOCUMENTS

| | | | |
|---|---|---|---|
| 747,321 | 12/1903 | Heeter | 166/196 X |
| 1,855,914 | 4/1932 | Hux | 166/196 X |
| 2,942,668 | 6/1960 | Maly et al. | 166/185 |
| 2,945,541 | 7/1960 | Maly et al. | 166/187 X |
| 3,385,367 | 5/1968 | Kollsman | 166/191 |
| 3,502,149 | 3/1970 | Pence, Jr. | 166/295 |

OTHER PUBLICATIONS

"Dowell Chemical Seal Ring and Dowell Chemical Seal Ring Gasket", Technical Report, Dowell Div. of The Dow Chemical Company, Form #DWL 1627-6-M-868, Tulsa, Okla., (1964) 20 pages.

*Primary Examiner*—Stephen J. Novosad
*Attorney, Agent, or Firm*—G. H. Korfhage

[57] ABSTRACT

A tool, e.g., a well packer, for restricting the flow of fluid through an annulus defined by the interior walls of a fluid conduit, e.g., well casing, and the exterior of a tubular member, e.g., the packer mandrel, is disclosed. The novelty of the present invention lies in the deformable packer element of such a tool, wherein in lieu of rubber, a chemically activated material which expands upon contact with fluid in the conduit is employed to effect the desired seal. A method of using such a tool is also disclosed.

11 Claims, 2 Drawing Figures

PACKER WITH CHEMICALLY ACTIVATED SEALING MEMBER AND METHOD OF USE THEREOF

BACKGROUND OF THE INVENTION

A. Field of the Invention

The present invention relates to restricting the flow of fluid through an annulus defined by the interior walls of a fluid conduit and the exterior of a tubular member within said fluid conduit. It also relates to a special tool for accomplishing same. In a specific context, it relates to a well packer tool and a method of using same.

B. Description of the Prior Art

It is frequently desired to restrict the flow of fluid through an annulus defined by the interior walls of a fluid conduit and the exterior of a tubular member within said fluid conduit. As used in the preceding sentence, "fluid conduit" includes elongated voids, such as defined by pipes, or by boreholes or mine shafts penetrating the earth, or the like structures having a substantially (i.e., disregarding small cracks, pores, and the like) closed cross sectional perimeter; excluded from the term as used herein are fluid conduits which do not have a completely defined cross section, e.g., an open trough. Examples of situations where such flow restriction is desired in wells include isolating a portion of an annulus between casing and the borehole or between concentric strings of casing or tubing, e.g., during the injection of treating fluids such as water or oil based fluids, acids, cement slurries, sand consolidation slurries and the like.

In the context of mines, it is sometimes necessary to prevent uncontrolled seepage from an overhead aquifer into a mine or water sensitive formation immediately above the mine. One approach to this problem is to insert a drain pipe into an overhead shaft in fluid communication with the aquifer and to seal off the annulus between the drain pipe and shaft so that the water or brine from the aquifer drains through the pipe.

Various tools known as packers have been developed for these purposes. The design and the general nature of a packer may be obtained from text books concerned with well drilling, operation, and reworking. Patents, e.g., U.S. Pat. Nos. 2,567,321; 3,436,084; 3,845,816; 3,135,329; 3,186,489; 3,252,517; 3,454,087; or 3,520,361; or catalogues, e.g., the 1976–'77 edition of "Composite Catalogue of Oil Field Equipment and Service" or "Baker Catalogue for 1960" containing general information on packers presently in use.

A packer is usually positioned and controlled by means of a suspending pipe, tubing, or section, to which it is threaded or otherwise connected. A packer is frequently provided with a laterally movable element having outwardly extending teeth or dogs for engagement with the inner wall of the casing when the packer has been located at the desired level.

In order to provide a fluid-tight seal in the annulus between, for example, a casing and tubing of a wellbore, a deformable rubber cylindrical packer element is usually employed which is relaxed when the packer is open but which, when the packer is to be closed, is mechanically forced axially outwardly, completely closing off the annulus. When the entire wellbore is to be closed off, a centrally positioned plugging member is employed as the packer mandrel instead of open tubing.

Another technique for sealing off an annulus is through use of what has become known in the trade as a chemical seal ring, whereby a fluid, usually a slurry, which sets into a rubberlike gel is injected into the annulus. Shaped articles such as tapes and gaskets have also been prepared from the gels formed from such fluids, inasmuch as the gels imbibe fluids (e.g., aqueous fluids such as water, steam, brines, or acid) and swell. Hence, should there temporarily be any leak about the gel, the gel swells to heal the leak. Use of chemical seal ring material to seal joints in mine shaft and tunnel linings is taught by Taradash et al. in U.S. Pat. Nos. 3,483,706 and 3,504,499. Representative of the chemical ring art are patents by Eilers and Parks, by Pence, Jr., and By Boughton, Pence, Jr., Stude, and Kucera, hereinafter discussed.

In Eilers et al., U.S. Pat. No. 3,306,870, there is disclosed an aqueous-base pumpable sealant composition which forms a gel, and once set, swells upon contact with aqueous fluids. The gel is radially expandable when subjected to compressive pressure. The sealant composition from which the gel is formed comprises an acrylamide type polymer in an aqueous solution of an inorganic compound to reduce the aqueous tension of pure water to certain specified levels. In the teachings of the patent relating to sealing subterranean formations, the gel and resulting seal are formed in situ.

Other compositions are disclosed by Eilers et al. in a series of related patents. U.S. Pat. Nos. 3,839,260; 3,839,262; 3,839,263; 3,845,004 and 3,847,858 are each divisions of U.S. 3,746,725, which is a continuation-in-part of U.S. 3,624,018, which in turn is a continuation-in-part of 3,511,313. All relate to gels formed from a slurry of a particulate, water soluble organic polymer, and an organo solvent therefor. Optionally, the slurry may contain an oxide, hydroxide, or salt of a polyvalent metal, to enhance the properties of the gel. The slurry can be injected into a void space and allowed to set to fill the void.

Similarly, gels prepared from colloidal suspensions of natural or modified natural polymers and certain metal salts are disclosed by Eilers et al. in U.S. 3,611,733.

In U.S. 3,554,287, Eilers et al. disclose a water swellable, resilient solid prepared from an aqueous slurry of certain salts and certain cynthetic polymers.

In U.S. 3,421,584, Eilers et al. prepare gels from water, certain water soluble polymers which are stable at low pH levels, a pH control agent, an acid-stable cross-linking agent, and a sodium silicate.

In U.S. 3,502,149, Pence, Jr. describe gels prepared from certain polymers, a polyhydric compound, water, and a $Cr^{+6}$ oxidizing agent. The setting time of such gels can be extended by inclusion of a small amount of cupric ions, as taught in Pence, U.S. 3,677,987.

To control excessive pressure build-up as a result of the gel imbibing fluid, Boughton et al., U.S. 3,593,799 teach means for relieving pressure on the gel once a preselected pressure has been reached.

Finally, a general discussion of the properties of and uses for chemical seal rings is found in "Dowell Chemical Seal Ring and Dowell Chemical Seal Ring Gasket Technical Report", Dowell Division of The Dow Chemical Company form number DWL 1627-6M-868.

The teachings of each of the patents and publications hereinabove discussed are expressly incorporated herein.

While certainly advantageous in its ability to conform to surface irregularities, pumping of a liquid slurry to form a chemical seal ring in situ is sometimes inconvenient, especially where the seal is to be placed overhead.

SUMMARY OF THE INVENTION

The present invention is an improvement in a tool for restricting the flow of fluid through an annulus defined by the interior walls of a fluid conduit and the exterior of a tubular member within the fluid conduit, which tool is of the type having an elongated mandrel, such as a tubular member, and radially surrounding at least a portion of the length of the mandrel, at least one unitary deformable packer element to prevent the flow of a fluid through the annulus. (By "unitary" is meant cast from a mold, machined, or the like, as distinguished from layers of strands or wrappings as in the interior of a golf ball.) The improvement lies in using as the deformable packer element, a chemically expandable packer element which expands upon contact with the fluid.

Another aspect of the invention is the use of the improved tool in restricting the flow of fluid through such an annulus. The method comprises providing such a tool, positioning it in the fluid conduit, and contacting the packer element with the fluid, thereby expanding the packer element sufficiently to cause the packer element to sealably engage the walls of the fluid conduit. When positioning the tool in the fluid conduit, it is readily apparent that in order for the packer element to properly engage the walls of the fluid conduit, the longitudinal axis of the packer should be in substantial alignment with the longitudinal axis of the segment of the fluid conduit where the tool is to be set.

BRIEF DESCRIPTION OF THE DRAWINGS

Similar parts in each figure bear identical reference numerals.

FURTHER DESCRIPTION OF THE INVENTION

The choice of material for the packer element employed in the present invention depends upon the fluid the flow of which it is expected to restrict. The material must be one which will swell sufficiently upon contact with the fluid to form a fluid restricting seal in the annulus. The degree of swelling required depends on several factors such as the pressure differential to be expected across the seal, the width of the annulus, the surface texture of the surfaces between which the seal is formed, and the like. Where the flow of an aqueous fluid, particularly water and other aqueous fluids such as brines naturally present in a subterranean formation, is to be restricted, any of the set compositions disclosed in the aforementioned chemical seal ring patents may be employed herein. Preferred for use herein are the set compositions of Pence, Jr., U.S. Pat. No. 3,502,149.

The present invention may comprise conventional mechanically activated packers wherein the fluid expandable substance is employed for the deformable packer element in lieu of the substantially non-chemically expandable rubber material conventionally employed in such mechanically activated packers. Where such a tool is employed, the tool is positioned in the fluid conduit, the deformable packer element is mechanically deformed in a conventional manner to cause the packer element to engage the walls of the fluid conduit, and the packer element is thereafter contacted with a suitable fluid to cause the packer element to expand and more tightly engage the walls of the conduit. This embodiment is particularly beneficial where the surface of the fluid conduit is uneven, e.g., as in an open borehole where bare formation surfaces define the conduit, or where joints, cracks, pits, scale or other surface discontinuities are present on the interior of a pipe. During the chemical expansion of the deformable packer element, the element expands to block such discontinuities which often are not blocked simply by mechanical expansion.

Figure 2:
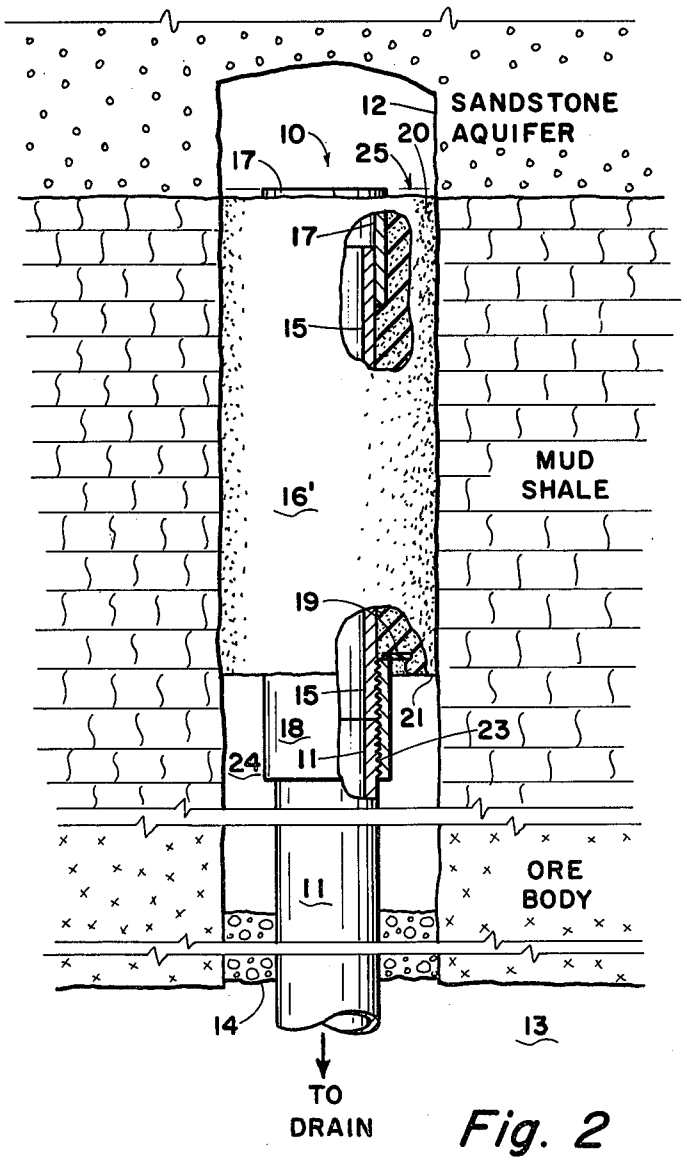
FIG. 2 is a side view, partly broken away and in section, showing a packer of the present invention in an expanded condition positioned in the same environment, but after contact with fluid.

A more simple and in that respect preferred embodiment of the present invention is illustrated in the Figures. There, packer 10 is joined in fluid communication with pipe 11 to drain aqueous formation fluids from a sandstone aquifer above a mud shale over a mine 13. In the environment illustrated, it is desired to drain water from the aquifer so as to prevent weakening of the shale, thereby reducing the risk of a mine collapse when the ore body is removed. The pipe 11 and hence the packer 10 are held in position by cement 14. The packer mandrel consists of an elongated pipe segment 15 of a material substantially unreactive (except for normal long term deterioration) with water and naturally occurring brines. The deformable packer element consists of a jacket 16 of a chemically expandable packer element which imbibes water and expands on contact with water and naturally occurring brines. The jacket 16 surrounds substantially the entire length of pipe segment 15, except for the ends of pipe segment 15 which are joined to connectors 17 and 18. Connectors 17 and 18 are available for connection with other pipe, e.g., connector 18 is shown connected to pipe 11. The connectors may be joined to the pipe segment 15 and/or pipe 11 by any suitable method, e.g., by a weld or adhesive as illustrated generally at 22 in FIG. 1, or, threads as illustrated at 23 in FIG. 2. The connectors 17 and 18, being of a larger diameter than pipe segment 15, also function to restrict the longitudinal expansion of the packer element 16 and thereby promote the radial expansion of the element, thereby resulting in a tighter seal. If desired, the latter function may also be accomplished by other means which will be obvious to those skilled in the art, e.g., by providing the pipe 15 with an annular flange (not shown) or by employing a washer 19 between the packer element 16 and the connector, such as illustrated above connector 18. As shown at 20 in FIG. 2, where there is only slight vertical restraint, the expandable packer element still tends to extrude somewhat along the annulus, whereas at 21, very little longitudinal expansion has occurred. Once the packer 10 is in position, aqueous formation fluids from the sandstone aquifer contact the expandable packer member 16 and cause it to swell as shown at 16' in FIG. 2, thereby restricting the flow of the water through the annulus 24. With flow through the annulus restricted, the formation fluid 25 drains in a controlled manner through connector 17, pipe segment 15, and pipe 11.

EXAMPLE

Figure 1:
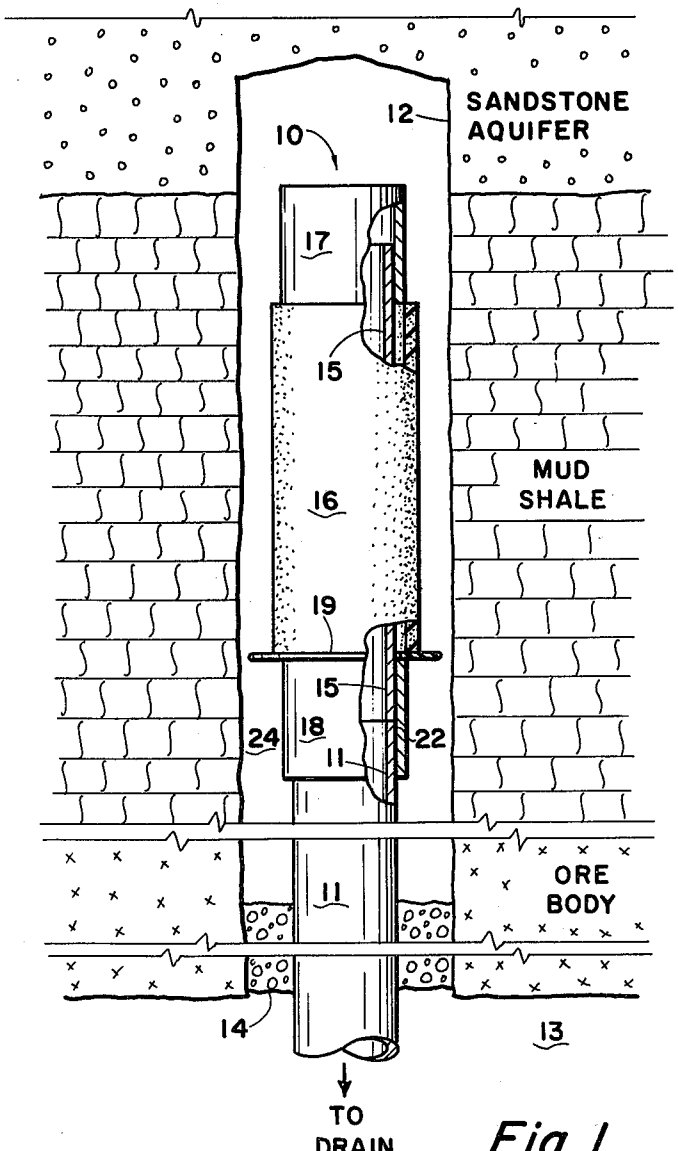
FIG. 1 is a side view, partly broken away and in section, showing a packer of the present invention in an unexpanded condition positioned in an overhead mine shaft prior to contact with fluid.

A slurry was prepared using, per gallon of fluid, the ingredients in the proportionate amounts hereafter specified. 0.017 Pounds of sodium dichromate was dissolved in 0.086 gallons of water, which solution was then added to 0.604 gallons of a 1:4 volume blend of glycerine and diethylene glycol. To the liquid mixture was added 3.45 pounds of a high molecular weight (viscosity of 2% solution, 25–30 cps at 25° C.) polyacrylamide nominally 1 to 4 percent hydrolyzed. The slurry was cast into a tubular plastic mold having an I.D. of 2 inches and an O.D. of 2.5 inches. The slurry was allowed to cure at ambient temperatures into a rubberlike gel. When set, the mold was removed, and a 6-inch cylinder of the gel was cut from the cast piece. This cyliner was mounted on a segment of plastic pipe to form a packer according to the present invention as illustrated in FIG. 1, except that no washer 19 was employed. The packer was connected to a drain via another pipe and positioned in an overhead shaft penetrating an aquifer above a mine, also as illustrated in FIG. 1. As far as can be determined, the gel expanded upon contact with the formation water, and the aquifer was successfully drained with no detectable leakage of the seal.

What is claimed is:

1. In a tool for restricting the flow of fluid through an annulus defined by the interior walls of a fluid conduit and the exterior of a tubular member within said fluid conduit, said tool being of the type having an elongated tubular mandrel and radially surrounding at least a portion of the length of the mandrel, at least one unitary deformable packer element for sealably engaging the walls of said fluid conduit to prevent the flow of a fluid through said annulus, the improvement which comprises: as the deformable packer element, a chemically expandable packer element which expands upon contact with said fluid, and means for mechanically expanding said packer element prior to chemical expansion of said element.

2. The tool of claim 1 wherein said packer element is chemically expandable upon contact with an aqueous fluid.

3. The tool of claim 1 wherein said packer element is chemically expandable upon contact with an aqueous fluid naturally present in a subterranean formation.

4. In a tool for restricting the flow of fluid through an annulus defined by the interior walls of a fluid conduit and the exterior of a tubular member within said fluid conduit, said tool being of the type having an elongated mandrel and radially surrounding at least a portion of the length of the mandrel, at least one unitary deformable packer element for sealably engaging the walls of said fluid conduit to prevent the flow of a fluid through said annulus, the improvement which comprises: as the deformable packer element, a chemically expandable packer element which expands upon contact with said fluid; and means for restraining longitudinal expansion of said packer element, to thereby promote radial expansion of said element.

5. The tool of claim 4 consisting essentially of an elongated segment of pipe of a material substantially unreactive with water and naturally occurring brines; means at at least one end of said segment for connecting said segment to another pipe to provide fluid communication between the respective interiors of said segment and said other pipe; radially surrounding substantially the entire length of said segment, a jacket of an expandable packer element which imbibes water and expands upon contact with water and naturally occurring brines; and means for restraining longitudinal expansion of said element, to thereby promote radial expansion of said element.

6. A method for restricting the flow of fluid through an annulus defined by the interior walls of a fluid conduit and the exterior of a tubular member within said fluid conduit, comprising (1) providing a tool of the type having an elongated tubular mandrel of a material substantially unreactive with said fluid, and radially surrounding at least a portion of the length of the mandrel, at least one unitary deformable packer element for sealably engaging the walls of said fluid conduit, wherein said packer element is a chemically expandable packer element which expands upon contact with said fluid, and means for mechanically deforming said packer element; (2) positioning said packer tool withhin said fluid conduit so that the longitudinal axis of said packer is in substantial alignment with the longitudinal axis of said fluid conduit; (3) mechanically deforming the packer element to cause said element to engage the walls of said fluid conduit; and (4) thereafter contacting said packer element with said fluid, thereby further expanding said packer into more tight engagement with the walls of said fluid conduit.

7. The method of claim 6 wherein said fluid is an aqueous fluid.

8. The method of claim 6 wherein said fluid is an aqueous fluid naturally present in a subterranean formation.

9. A method for restricting the flow of an aqueous fluid naturally present in a subterranean formation through an annulus defined by the interior walls of a fluid conduit and the exterior of a tubular member within said fluid conduit, comprising (1) providing a tool of the type having an elongated tubular mandrel of a material substantially unreactive with said fluid and radially surrounding at least a portion of the length of the mandrel at least one unitary deformable packer element for sealably engaging the walls of said fluid conduit, wherein said packer element is a chemically expandable packer element which expands upon contact with said fluid and said tool consists essentially of an elongated segment of pipe as said mandrel, means at at least one end of said segment for connecting said segment to another pipe to provide fluid communication between the respective interiors of said segment and said other pipe, said packer element radially surrounding substantially the entire length of said segment, and means for restricting the longitudinal expansion of said packer element to thereby promote the radial expansion of said element, (2) connecting said tool to another pipe; (3) positioning said pipe with said tool attached in said fluid conduit so that said tool is placed at a preselected location in said fluid conduit so that the longitudinal axis of said packer is in substantial alignment with the longitudinal axis of said fluid conduit; and (4) contacting said packer element with said fluid, thereby expanding said packer element sufficiently to cause said packer element to sealably engage the walls of said fluid conduit.

10. The method of claim 9 wherein said fluid conduit is an elongated passageway through a subterranean formation and the interior walls of said conduit comprise the bare formation surfaces defining said passageway.

11. A method for draining aqueous fluid from an aquifer above a mine where the aquifer is in fluid communication with the mine via a generally vertical shaft extending upward from the mine so that fluid from said aquifer drains into said shaft, comprising:

(1) providing a tool of the type having an elongated tubular mandrel of a material substantially unreactive with said fluid and radially surrounding at least a portion of the length of the mandrel at least one unitary deformable packer element for sealably engaging the walls of said shaft, wherein said packer element is a chemically expandable packer element which expands upon contact with said fluid and said tool consists essentially of an elongated segment of pipe as said mandrel, means at at least one end of said segment for connecting said segment to another pipe to provide fluid communication between the respective interiors of said segment and said other pipe, said packer element radially surrounding substantially the entire length of said segment, and means for restricting the longitudinal expansion of said packer element to thereby promote the radial expansion of said element;

(2) connecting said tool to another pipe;

(3) positioning said pipe with said tool attached in said shaft from said mine so that said tool is placed at a preselected location in said shaft with the longitudinal axis of said packer in substantial alignment with the longitudinal axis of the walls of the shaft;

(4) contacting said packer element with said fluid, thereby expanding said packer element sufficiently to cause said packer element to sealable engage the walls of said shaft so that flow of fluid in the annulus between the pipe segment and the walls of the shaft is restricted; and (5) thereafter draining aqueous fluid from the aquifer through said pipe segment and said pipe.

* * * * *